US009976816B2

(12) United States Patent
Moreau et al.

(10) Patent No.: US 9,976,816 B2
(45) Date of Patent: May 22, 2018

(54) CONNECTING REINFORCEMENT FOR BETWEEN THE PLATES OF A HEAT EXCHANGER

(75) Inventors: Sylvain Moreau, Spay (FR); Francois Busson, Saint Gervais en Belin (FR); Mohamed Ibrahimi, Allonnes (FR)

(73) Assignee: VALEO SYSTEMES THERMIQUES, Le Mesnil Saint Denis (FR)

( * ) Notice: Subject to any disclaimer, the term of this patent is extended or adjusted under 35 U.S.C. 154(b) by 36 days.

(21) Appl. No.: 14/006,893

(22) PCT Filed: Feb. 20, 2012

(86) PCT No.: PCT/EP2012/052877
§ 371 (c)(1),
(2), (4) Date: Jan. 31, 2014

(87) PCT Pub. No.: WO2012/126687
PCT Pub. Date: Sep. 27, 2012

(65) Prior Publication Data

US 2014/0151006 A1 Jun. 5, 2014

(30) Foreign Application Priority Data

Mar. 23, 2011 (FR) ..... 11 00872

(51) Int. Cl.
*F28F 3/08* (2006.01)
*F28D 9/00* (2006.01)
*F28D 1/03* (2006.01)

(52) U.S. Cl.
CPC ..... *F28F 3/08* (2013.01); *F28D 1/0333* (2013.01); *F28D 1/0341* (2013.01);
(Continued)

(58) Field of Classification Search
CPC .... F28D 1/0325; F28D 1/0333; F28D 1/0341; F28D 9/0031; F28D 9/0043;
(Continued)

(56) References Cited

U.S. PATENT DOCUMENTS 4,878,483 A * 11/1989 Todorski ..... F24B 7/025 126/523
5,634,518 A * 6/1997 Burgers ..... 165/153
(Continued)

FOREIGN PATENT DOCUMENTS

EP 2105693 A1 9/2009
FR 2128125 A2 10/1972
(Continued)

OTHER PUBLICATIONS

English language abstract and translation for EP 2105693 extracted from the espacenet.com database on Feb. 3, 2014, 35 pages.
(Continued)

*Primary Examiner* — Jianying Atkisson
*Assistant Examiner* — Joel Attey
(74) *Attorney, Agent, or Firm* — Howard & Howard Attorneys PLLC

(57) ABSTRACT

A heat exchanger comprises a multiplicity of stacked plates having a thickness of less than 0.3 mm, each of which is provided with a male dished member (8) which delimits a fluid distribution zone (6, 7) in the exchanger (1). At least a first plate (3) and a second plate (4) each comprise a peripheral edge (25) which is assembled in a fluid-tight manner in order to form a fluid circulation pipe. The exchanger also comprises at least one insert (5) which is provided with a female dished member (9), and the male dished member (8) of the plates (3, 4) is configured to be introduced into the female dished member (9) of the insert (5) in order to ensure fixing between two adjacent fluid
(Continued)

circulation pipes or between a side plate (15, 16) and an adjacent fluid circulation pipe.

18 Claims, 3 Drawing Sheets

(52) U.S. Cl.
CPC ..... *F28D 1/0325* (2013.01); *F28D 9/0031* (2013.01); *F28D 9/0043* (2013.01); *F28D 9/0056* (2013.01); *F28F 3/083* (2013.01); *F28F 3/086* (2013.01); *F28F 2225/00* (2013.01); *F28F 2225/08* (2013.01); *F28F 2275/122* (2013.01)

(58) Field of Classification Search
CPC ..... F28D 9/0056; F28D 1/033; F28F 3/08; F28F 3/083; F28F 3/086; F28F 2225/08; F28F 2225/00
USPC ..... 165/153, 906
See application file for complete search history.

(56) References Cited

U.S. PATENT DOCUMENTS 5,875,834 A * 3/1999 Brooks ..... F28D 1/0333 165/11.1
5,909,766 A * 6/1999 Kobayashi ..... F28D 1/0333 165/153
5,918,664 A * 7/1999 Torigoe ..... F25B 39/022 165/153
6,607,026 B1 * 8/2003 Naji ..... F28D 1/0333 165/135
6,698,509 B2 * 3/2004 Rong ..... F28D 1/0341 165/153
7,219,717 B2 * 5/2007 Hanafusa ..... F25B 39/022 165/153
7,520,319 B2 * 4/2009 Ohno ..... F28D 1/0333 165/153
2003/0159805 A1 * 8/2003 Muhammad ..... B21D 53/085 165/76
2005/0269066 A1 * 12/2005 Horiuchi ..... F28D 1/0333 165/153
2009/0126911 A1 * 5/2009 Shore ..... F28D 1/0325 165/109.1

FOREIGN PATENT DOCUMENTS

FR 2929388 A1 10/2009
JP 09-113171 A 5/1997
JP 2001116485 A 4/2001

OTHER PUBLICATIONS

English language translation for FR 2128125 extracted from the espacenet.com database on Feb. 3, 2014, 17 pages.
English language translation for FR 2929388 extracted from the espacenet.com database on Feb. 3, 2014, 50 pages.
English language abstract and translation for JP 2001116485 extracted from the PAJ database on Feb. 3, 2014, 74 pages.
English language abstract and translation for JP 09-113171 extracted from the PAJ database on Feb. 3, 2014, 28 pages.
International Search Report for Application PCT/EP2012/052877 dated Mar. 28, 2012, 5 pages.

* cited by examiner

CONNECTING REINFORCEMENT FOR BETWEEN THE PLATES OF A HEAT EXCHANGER

RELATED APPLICATIONS

This application claims priority to and all the advantages of International Patent Application No. PCT/EP2012/0528277, filed on Feb. 20, 2012, which claims priority to French Patent Application No. FR 1100872, filed on Mar. 23, 2011.

The invention involves the field of heat exchangers between two fluids, in particular for cooling a flow of air by means of heat exchange with a cooling fluid.

Such heat exchangers are used in the field of air conditioning, for example, of motor vehicles, and are in particular evaporators for an air conditioning circuit of a vehicle. They allow the heat to be exchanged between a first fluid, in particular air, and a second fluid, for example, a cooling fluid. They comprise a bundle of tubes which are intended for the circulation of the second fluid and which are arranged in a parallel manner in one or more rows, inlet and/or outlet cross-members for the second fluid in the tubes, and spaces between the tubes for the circulation of the first fluid.

Document FR2929388A1 discloses a heat exchanger whose tubes are produced by means of the assembly of a first plate and a second plate which are identical to each other, each having a concavity which is directed one towards the other, and a respective peripheral edge which is fitted to the other in a sealed manner in order to create a fluid circulation pipe, called a tube, which is sealed with respect to the cooling fluid and which allows it to circulate therein. Such exchangers therefore comprise a plurality of plates which are stacked from one side to the other of the exchanger in order to form a tube bundle. Each tube has two ends and consequently each plate also has two ends.

Such tubes have, for example, in the region of the ends thereof, a fluid distribution zone, also called a collection space, which allows the cooling fluid to be collected and distributed.

Each plate is thus provided with a dished member which delimits the fluid distribution zone in the exchanger and which allows a connection to be established between two adjacent plates of two successive tubes. These connections ensure the stability of the structure and allow the sealing to be ensured between an internal space of the heat exchanger and the surrounding environment, that is to say, between the inner space of the tubes and the air. They also allow the cooling fluid to circulate in the exchanger by passing from one tube to the other.

Between the ends thereof, the tubes have a central portion, called a tube body, which guides the cooling fluid from one end to the other.

Since the tubes are in contact with each other only in the region of the ends thereof, there are spaces between the bodies of two adjacent tubes. These spaces are used to circulate the first fluid through the heat exchanger so that heat is exchanged with the second fluid which flows inside the tubes.

The exchanger also comprises an inlet tube which conveys the cooling fluid to the tubes and which is connected to the tubes by means of an inlet cross-member and an outlet tube which discharges the cooling fluid from the tubes and which is connected to them by means of an outlet cross-member.

In order to increase the cooling power of the exchanger to the maximum extent whilst reducing its mass, document FR2929388A1 proposes a thickness of less than 0.3 mm for the plates which form the tubes. A problem arises when the tube(s) is/are subjected to mechanical stresses linked, for example, to the operation of the vehicle. These stresses affect the plates of the exchanger via the cross-members. Since the plates have a thickness of less than 0.3 mm, they become deformed under the action of the stress, which may bring about a breakage between two adjacent plates, thus creating a leakage which allows the cooling fluid to escape.

An object of the invention is to overcome the above-mentioned problem by proposing to improve the resistance to stresses in the region of the connections between two adjacent plates whilst continuing to use plates having a thickness of less than 0.3 mm.

To this end, there is proposed a heat exchanger comprising a multiplicity of stacked plates having a thickness of less than 0.3 mm, each of which is provided with a male dished member which delimits a fluid distribution zone in the exchanger, at least a first plate and a second plate each comprise a peripheral edge which is assembled in a fluid-tight manner in order to form a fluid circulation pipe.

According to the invention, the heat exchanger comprises at least one insert which is provided with a female dished member, the male dished member of the plates being configured to be introduced into the female dished member of the insert in order to ensure fixing between two adjacent pipes or between a side plate and an adjacent pipe.

That is to say, according to the invention, the heat exchanger has at least one insert which is provided with a protruding edge which is configured to extend and surround the male dished member of an adjacent plate in order to increase the stress resistance of the connection between the insert and the plate.

The multiplicity of plates extend over a width between a first side of the exchanger and a second side of the exchanger. The plates located at the sides of the exchanger are thus referred to as "side plates".

According to an aspect of the invention, the insert is integral with a first or second plate of a pipe.

According to an aspect of the invention, the insert is a component which is fitted to a first or second plate of a pipe or to a side plate.

According to an aspect of the invention, the female dished member of the insert has a tubular section which terminates in an edge which covers the male dished member of the first and/or second plate, the edge extending in continuation of the tubular section. It is intended to be understood in this instance that the edge forms a cylindrical cross-section which is coaxial with the tubular section and which has an equivalent diameter. By covering the male dished member of one of the plates with the female dished member present on the insert, the connection between the plate and the insert is thus reinforced, regardless of the direction of the stresses to which the connection is subjected.

According to an aspect of the invention, the male dished member of the first and/or second plate has a tubular section which terminates in a base which extends in a plane perpendicular to a centre axis of the tubular section. The base is, for example, provided with an opening through which the fluid passes. It is thereby possible to define the path of the second fluid within the exchanger, by selecting a base which may or may not be provided with an opening.

According to an aspect of the invention, the multiplicity of plates comprise a fluid circulation portion which is interposed between two plate ends, the male dished member of the first and second plates being formed at least at one end of the plates.

According to an aspect of the invention, the first and second plates which delimit a pipe or the assembly formed by a plate a pipe and a side plate each comprise at an end both a male dished member and a female dished member. In this manner, the reinforced connection between the plate and the insert is doubled and its strength is thus improved.

According to an aspect of the invention, each end of the plates comprises both a male dished member and a female dished member.

According to an aspect of the invention, the first twenty-five percent of the width from one side of the exchanger is configured so that the male dished member of each plate is introduced into the female dished member of each insert in order to ensure fixing between the plates. It will thus be appreciated that the exchanger is provided in this instance with a plurality of inserts. The plates located in the remaining seventy-five percent of the width thus do not have such inserts. In this manner, reinforcement is provided in particular for the zone of the exchanger that is subjected mainly to the stresses transmitted by the cooling fluid inlet and/or outlet tubes, that is to say, the zone located near the inlet and/or outlet cross-members which are themselves positioned at one of the sides of the exchanger.

According to an aspect of the invention, since the exchanger comprises a first side plate which is located in the region of the first side of the exchanger and a second side plate which is located in the region of the second side of the exchanger, the insert is installed against each of the side plates so that the female dished member of the insert covers the male dished member of the plate adjacent to the first side plate and the plate adjacent to the second side plate. It will be understood in this instance that such an exchanger comprises two inserts, each one being soldered to a side plate.

The first connections between a plate and an insert starting from the sides of the exchanger are thus reinforced. The side plates have, for example, a thickness of 1 mm, greater than the thickness of the other plates in order to increase the strength of the first connection. The insert has in particular a thickness greater than 0.3 mm.

The appended drawings will show clearly how the invention can be implemented. In these figures, identical reference numerals refer to elements which are similar.

In conventional manner and in order to simplify the description of the heat exchanger 1 according to the invention, a Cartesian reference system (x, y, z) is formed and the direction o-x is defined as being the width of the exchanger, o-y the depth thereof, and o-z the height thereof. The directions o-x, o-y and o-z are parallel with the axes o-x, o-y and o-z, respectively. The embodiment described below is an evaporator but of course the invention also covers a condenser, a radiator or any other exchanger which is constituted according to claim 1, regardless of the fluids which pass through it.

Figure 1:
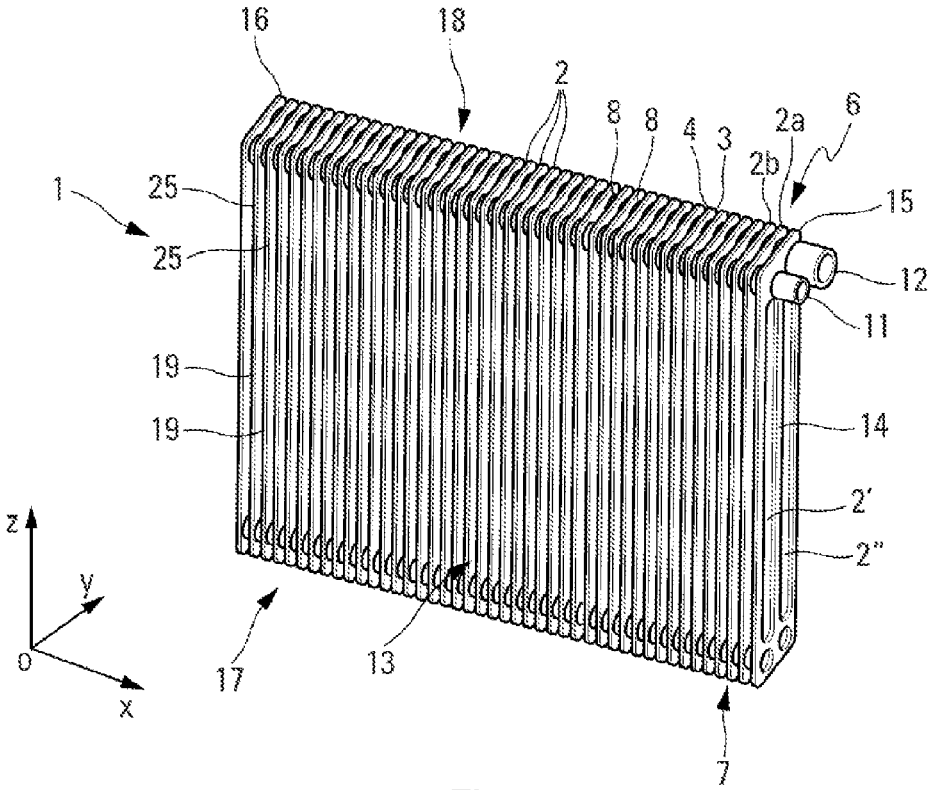
FIG. 1 is a schematic, perspective view of a heat exchanger.

As can be seen in FIG. 1, the heat exchanger or evaporator 1 comprises a stack of fluid flow pipes, called a tube 2. Each tube 2 comprises a first plate 3 and a second plate 4 which are formed from a metal sheet, or metal strip which is pressed in the form of dishes. The plates 3 and 4 are identical to each other and have their concavities directed towards each other in the direction o-x. The first and second plates 3 and 4 each comprise a peripheral edge 25 which is assembled in a fluid-tight manner, for example, by means of soldering, in order to form a tube 2 and which delimits an inner space of the tube 2. Each of the plates is provided with a male dished member 8 which delimits a fluid distribution zone 6, 7 in the exchanger 1. This male dished member 8 is, for example, located in the region of at least one end of each plate in the direction o-z and in particular at the two ends of each plate in the direction o-z. In this manner, a first plate 3 and a second plate 4 of the same tube 2 delimit a fluid distribution zone 6, 7 in the exchanger in the regions of the ends of the tube 2 in the direction o-z, that is to say, over the height thereof. The fluid distribution zone located in the region of the upper portion of a tube 2 along the axis o-z is called the upper distribution zone 6 whilst the portion located in the region of the lower portion of a tube 2 along the axis o-z is called the lower distribution zone 7.

Fluid, called a second fluid, in particular a cooling fluid which circulates in an air conditioning circuit of a motor vehicle when the heat exchanger 1 is an evaporator, a gas cooler or a condenser, can thus pass through the tube 2. This may also be a heat-exchange fluid which circulates in a cooling circuit of a heat or electric engine of a motor vehicle when the heat exchanger 1 is a radiator.

The fluid distribution zones 6, 7 occupy, for example, a minority fraction of the height of the tube 2 at the upper and lower portions thereof, the remainder of the height of the tube 2 being occupied by a body region of smaller thickness. A fluid circulation portion 19 is thus interposed between two fluid distribution zones, that is to say, between two ends of the same plate. In this manner, two adjacent tubes 2 are in contact in the region of their fluid distribution zones, that is to say, in the region of the male dished member 8 present on the adjacent plates which belong to two different tubes 2. A free space 13 located between two body regions of smaller thickness of two adjacent tubes 2 defines a path in the direction o-y for a first fluid, for example, of the air to be cooled. Insertion members (not illustrated) are in particular installed in the free space 13, in order to increase the thermal exchange between the external walls of the tubes 2 and the flow of air.

The metal sheet which forms the plates 3 and 4 is, for example, an alloy of aluminum and has a thickness of less than 0.3 mm, preferably between 0.24 and 0.28 mm and in particular of 0.27 mm. An internal interference member, in the form of a zig-zag (not illustrated) may be arranged between the plates 3 and 4 of the same tube 2 in order to promote the heat exchanges between the cooling fluid and the internal wall of the tube 2.

The tube 2 may have a sealed connection zone 14, which extends over the height thereof, that is to say, in the direction o-z, and which divides the same tube 2 into a first half-tube 2' and a second half-tube 2", and which thus allows the tube 2 to define two paths for the cooling fluid. The first half-tube 2' of a tube 2 is located towards a front face 17 of the exchanger and the second half-tube 2" of the same tube 2 is located towards a rear face 18 of the exchanger. The sealed connection zone thus extends from the upper distribution zone 6 as far as the lower distribution zone 7, at the mid-width of the tube 2 in the direction o-y. The sealed connection zone may or may not have a passage (not illustrated) in the region of the upper fluid distribution zone 6 or the lower distribution zone 7, in order to allow the fluid to pass from the first half-tube 2' to the second half-tube 2" of the same tube 2, that is to say, in the direction o-y.

Furthermore, two plates 15, 16 called side plates are arranged on the sides of the exchanger in the direction o-x and serve in particular to protect the last intermediate members of the exchanger located at each side of the heat exchanger 1. The term first side of the exchanger 1 refers to the side located in the right-hand portion of FIG. 1 and the first side plate 15 refers to the plate located in the region of the first side. In the same manner, the term second side 16 of the exchanger 1 refers to the side located in the left-hand portion of the drawing and the second side plate 16 refers to the plate located in the region of the second side.

In this manner, from one side to the other in the direction o-x and from right to left in FIG. 1, the heat exchanger 1 is composed of the first side plate 15, which is connected in the region of a first connection to the first plate 3 of a first tube 2*a* which is itself connected to the second plate 4 of the first tube 2*a*, which itself is connected to the first plate 3 of a second tube 2*b*; a plurality of plates are then stacked in this manner to form N tubes, the second plate 4 of an $N^{th}$ tube being connected to the second side plate 16.

The heat exchanger 1 further comprises a fluid inlet cross-member 11 and a fluid outlet cross-member 12 which are arranged on an outer face of the first side plate 15 in continuation of the upper fluid distribution zone 6 and/or lower fluid distribution zone 7. The cross-members 11 and 12 protrude relative to the first side plate 15 and may in particular have a tubular cross-section whose centre axis is directed in the direction o-x. The cross-members 11 and 12 may have different diameters.

The embodiment described by way of example in FIG. 1 has the fluid inlet cross-member 11 and fluid outlet cross-member 12 arranged at the side of the first side plate 15 of the heat exchanger 1. However, the present invention also covers all other arrangements of the cross-members 11, 12 relative to the exchanger 1.

Figure 2:
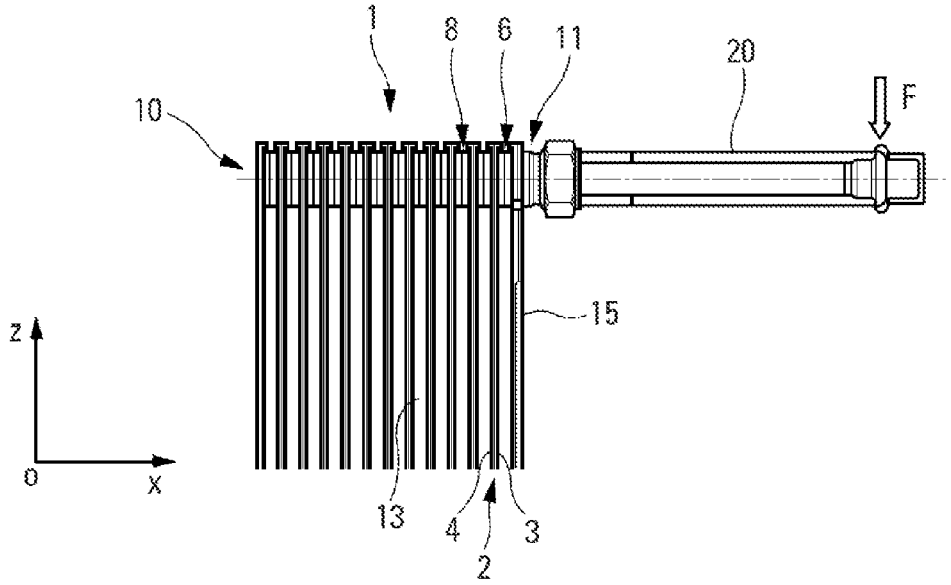
FIG. 2 is a partial schematic plan view of an embodiment of an evaporator and an inlet tube for cooling fluid.

FIG. 2 illustrates in greater detail the zone of the exchanger 1 close to the inlet cross-member 11 and outlet cross-member 12 (not illustrated in FIG. 2). It also illustrates an inlet tube 20 which is connected to the inlet cross-member 11 and which allows the fluid to enter the exchanger 1. In contrast, an outlet tube allows the cooling fluid to be discharged from the heat exchanger but is not illustrated in the figures. These tubes are often subjected to stresses F which are linked, for example, to the operation of the vehicle and transmit them via the inlet cross-member 11 and outlet cross-member 12 to the exchanger 1.

In this manner, the cooling liquid describes a path in the exchanger between the inlet cross-member 11 and outlet cross-member 12 as a function of the presence or absence of the openings 10 located in the region of the fluid distribution zones, between two half-tubes 2' or two half-tubes 2" of two adjacent tubes 2 and the presence or absence of passages located in the region of the connection zone 14 which allows the fluid to pass from one half-tube 2' to the other half-tube 2' of the same tube 2, that is to say, from one face to the other of the exchanger in the direction o-y.

Figure 3:
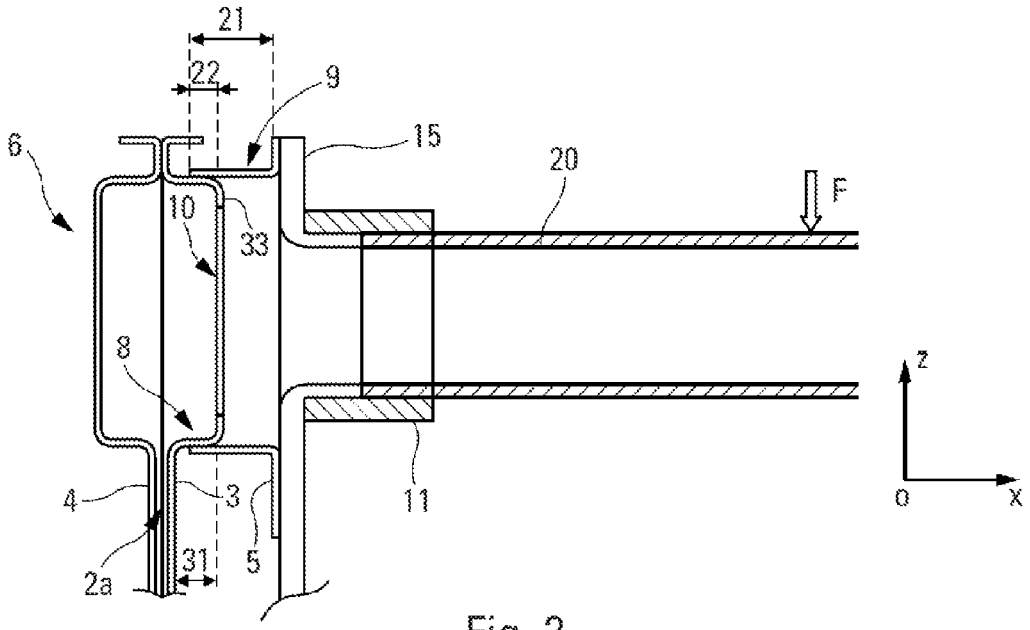
FIG. 3 is a partial schematic view of a connection between two adjacent plates of an evaporator according to the invention.

FIG. 3 illustrates an upper distribution zone 6 which is formed by the assembly of the first plate 3 of the first tube 2*a* and the second plate 4 of the first tube 2*a*. FIG. 3 also illustrates an insert 5 which is in accordance with the invention and which is in particular provided with a female dished member 9, and a cooling fluid inlet cross-member 11 and an inlet tube 20 which allow the cooling fluid to enter the exchanger 1. According to the invention, the male dished member 8 of the first and/or second plate (3, 4) is configured to be introduced into the female dished member 9 of the insert 5 in order to ensure that they are fixed. In the example illustrated in FIG. 3, the insert 5 is adjacent to the first plate 3 and covers the male dished member 8 of this plate. It is further located on an inner face of the first side plate 15 of the exchanger 1. The insert 5 thus defines a means for rigid connection to the first plate 3 and delimits with the side plate 15 a collection box through which the cooling fluid is capable of circulating.

In this manner, when the inlet tube 20 and/or outlet tube is subjected to stresses F, regardless of the directions thereof, which are transmitted to the exchanger in the region in particular of the reinforced connection between the first side plate 15 and the first plate 3 of the first tube 2*a*, the risk of breakage of the metal sheet or the soldered connection is reduced. The reliability of the exchanger is increased accordingly.

Figure 4:
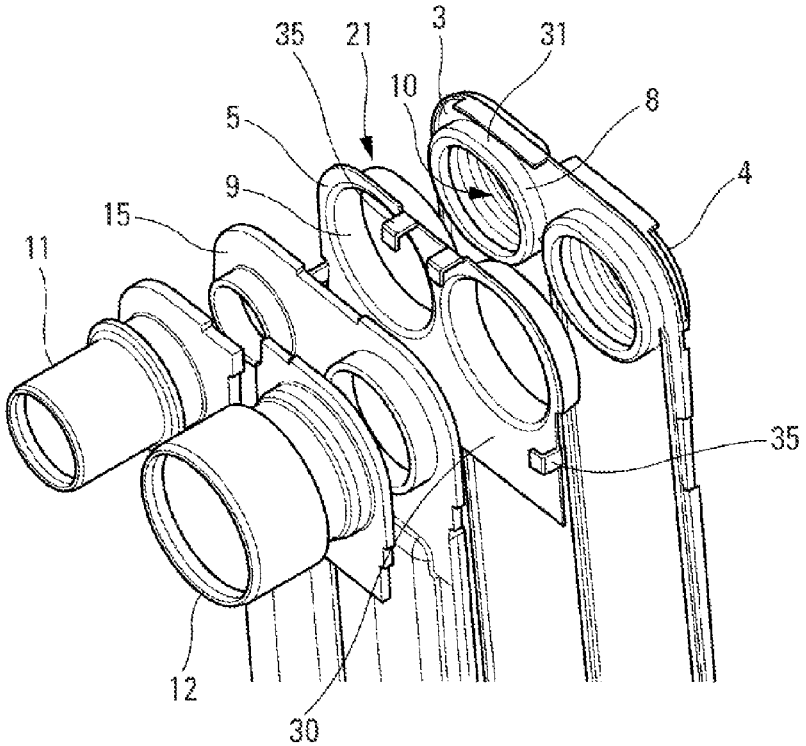
FIG. 4 is an exploded perspective view of a portion of the exchanger comprising an insert according to the invention.

FIG. 4 illustrates in a more detailed manner an insert 5 which is capable of being fitted to the first side plate 15. The insert 5 in this instance is a fitted component, that is to say, separate from the plates before assembly and installed between them at the time of pre-assembly. It could also be fitted to first plates 3, second plates 4 and/or to the second side plate 16. The insert 5 comprises a planar cross-section 30, at the left-hand side of the figure, which is intended to come into contact with and be soldered against the first side plate 15 against which the insert 5 is fitted. The planar cross-section 30 thereby ensures the mechanical reinforcement, and the insert 5 ensures the operation thereof.

The planar cross-section 30 comprises two lateral portions, a lower portion and an upper portion which together define the periphery of the insert 5. When the insert 5 is positioned in the exchanger, the depth thereof corresponds to the depth of the plates, that is to say that the distance between the two lateral portions thereof in the direction o-y is equal to the depth of the plates in the direction o-y. In contrast, the insert 5 is less high than the plates, that is to say, the distance between the upper portion thereof and the lower portion thereof is less than the height of the plates in the direction o-z.

The insert 5 may, for example, be provided with a plurality of tongues 35, which are located on the periphery of the insert 5, perpendicularly relative to the planar cross-section 30, and which are capable of being crimped or folded on the first side plate 15 to which the insert 5 is connected, in order to ensure that it is fixed. The tongues 35 in particular allow the preassembly of the insert 5 against the first side plate 15 to be ensured before the soldering operation. The insert comprises, for example, four tongues 35, two of which are located on the upper portion and one on each of the lateral portions thereof.

At the opposite side of the planar cross-section 30, that is to say, at the right-hand side of the figure, there are located two female dished members 9 which are intended to cover two male dished members 8 of the first plate 3, adjacent to the first side plate 15 to which the insert 5 is fitted. The male dished members 8 and female dished members 9 therefore have a complementary shape which allows one (male 4) to be fitted in the other (female 9). Although not illustrated, the insert 5 may also be provided with a female dished member 9 and a male dished member 4 if the first plate 3 and second plate 4 also have a corresponding male dished member 8 and female dished member 9.

According to a variant of the invention which is not illustrated, the insert 5 is integral with a plate and may be integral with a first plate 3, a second plate 4, a first side plate 15 and/or a second side plate 16. In this instance, it is constituted by the same material as the plate from which it originates, that is to say that it is produced in an integral manner with the plate, forming with it a single unit of material. Such a configuration of the insert 5 becomes evident on the plate on which it is located in particular as a result of the presence of a shoulder, in the region of which the insert 5 begins, that is to say, close to the end of the plate on which the insert 5 is located. If the insert 5 is integral with a plate, it has the same shape as that of the insert 5 which is fitted to the plate as described above.

This shape of the insert 5, whether it is fitted to or integral with a plate, advantageously allows it to be placed between two adjacent plates of the exchanger, regardless of their position amongst the multiplicity of plates.

In this manner, according to another embodiment of the exchanger, two adjacent tubes 2, regardless of their position in the exchanger 1, comprise a first plate 3 of one of the tubes 2 which is assembled with a second plate 4 of another of the tubes via an insert 5. Consequently, one of the first and second plates 3, 4 comprises a connection insert 5 so that the male or female dished member 8 or 9 of a tube is configured to be introduced in or cover the female or male dished member 9 or 8 of a tube 2 which is directly adjacent thereto, respectively.

According to a first production variant, each of the connections between the tubes 2 comprises an insert 5.

According to a second production variant, some of the connections between the plates comprise an insert 5, for example, some connections located in the region of the first twenty-five percent of the width of the exchanger 1, starting from the first side of the exchanger 1, or only between the first and second side plates 15, 16 and the plates 3, 4 thereof which are directly adjacent. Depending on the degree of stress resistance which it is desirable to confer on the exchanger 1, one or other of these production variants is selected.

Still with the objective of reinforcing the structure, side plates 15, 16 having a thickness which is approximately 1 mm are advantageously but not exclusively selected. In the same manner, inserts 5 are selected having a thickness greater than 0.3 mm, but it may be advantageous to select an insert 5 having a thickness which is identical to the thickness of the first and second plates 3, 4 which constitute a tube.

FIG. 3 further illustrates an aspect of the invention according to which the female dished member 9 of the insert 5 has a tubular section 21 whose centre axis is directed in the direction o-x. It terminates in an edge 22 which extends in continuation of the tubular section 21 and which covers the male dished member 8 of the first plate 3 of the first tube 2*a*. It will be appreciated in this instance that the edge 22 at least partially straddles the male dished member 8. This edge 22 and this tubular section form an integral assembly. In practice, it is a tube having an inner diameter or equal to the outer diameter of the male dished member 8.

This male dished member 8 of the first plate 3 or the second plate 4 also has a tubular section 31 which is configured so that it can be introduced in the tubular section 21 of the insert 5 but which itself terminates in a base 33 which extends in a plane perpendicular to a centre axis of the tubular section 21, that is to say, in the direction o-x. The base 33 is, for example, provided with an opening 10 through which the fluid passes. It is via these tubular sections 21 and 31 that the fluid will circulate between two adjacent tubes 2 inside the exchanger 1.

According to another embodiment of the exchanger 1, each tube 2 is formed by a first half-tube 2' and a second half-tube 2" which are separated from each other by the sealed cross-section. Each plate must be provided with two dished members which delimit the fluid distribution zone 6, 7 in the exchanger 1.

Figure 5:
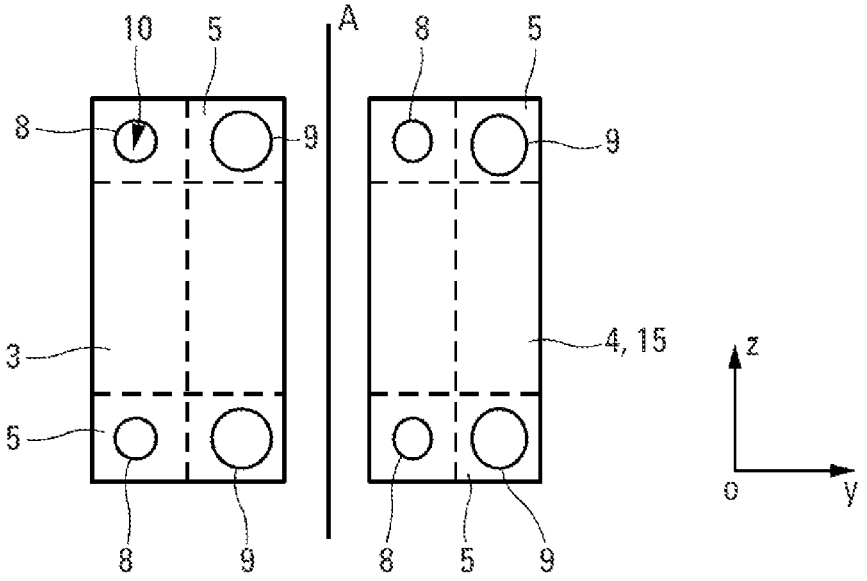
FIG. 5 is a schematic plan view of two adjacent plates of an evaporator.

As illustrated in FIG. 5 and in a particularly advantageous manner, the first plate 3 and the second plate 4 have at the same time a male dished member 8 and a female dished member 9, at least in the region of one end of the plates, and in particular at both ends. In this manner, the fluid will be able to circulate between the half-tubes 2' of two adjacent tubes 2 and/or between the half-tubes 2" of two adjacent tubes 2.

FIG. 5 illustrates a first plate 3 and a second plate 4 which belong to two adjacent tubes 2 or a first plate 3 and a first side plate 15, which are illustrated side by side in this instance. The first plate 3 located at the left-hand side of FIG. 5 is stacked on the second plate 4 or on the first side plate 15 which is located at the right in the figure by carrying out a rotation through 180 degrees about the axis A. In this manner, when the two plates are stacked to form the exchanger 1, a female dished member 9 and a male dished member 8 located at the corresponding end of the first adjacent plate 3 are caused to correspond to a male dished member 8 and a female dished member 9 of the insert 5 located at the end of a second plate 4 or a first side plate 15. The connection between the two plates is thus reinforced against the various stresses which may be applied in the plane o-y-z. The advantage of such a structure is that each plate is identical, that is to say, pressed by the same pressing impression. The logistics are thus simplified since one and the same type of plate is used which is inverted in order to produce the first and second plate according to the invention. Each face of the exchanger is also reinforced, which allows a reinforcement according to the invention to be readily provided simultaneously for the two tubes, that is to say, an inlet tube and outlet tube.

The heat exchangers according to the invention are used in particular in heating, ventilation and/or air conditioning installations of motor vehicles. They may also be engine cooling radiators, passenger space heating radiators, condensers, gas coolers or evaporators of the air conditioning circuit, supercharger and oil exchanger air coolers.

The invention claimed is:

1. A heat exchanger comprising a multiplicity of stacked plates, each one of the stacked plates having a thickness of less than 0.3 mm and provided with a male dished member which delimits a fluid distribution zone in the heat exchanger, wherein the multiplicity of stacked plates comprises at least a first plate and a second plate, each one of the first plate and the second plate comprises a peripheral edge which is assembled in a fluid-tight manner in order to form a fluid circulation pipe, and wherein the exchanger comprises at least one insert which is provided with a female dished member, the male dished member of the stacked plates being configured to be introduced into the female dished member of the at least one insert in order to ensure fixing between a side plate and an adjacent fluid circulation pipe;

wherein each one of the at least one insert includes a planar member and a tubular section, the planar member extending laterally outward from the tubular section so as to define a periphery of the at least one insert, the planar member being attached to the side plate and the tubular section having an interior and receiving the male dished member within the interior of the tubular section so as to reinforce the heat exchanger;

wherein the male dished member of each one of the stacked plates has a male tubular section which terminates in a base, with the base extending in a plane perpendicular to a center axis of the male tubular section and radially inwardly from the male tubular section toward the center axis, with the male tubular section being received in the interior of the tubular section of the at least one insert; and wherein the male tubular section terminates in an end opposite to the base, and the at least one insert terminates in an edge, with the edge being disposed opposite to the planar member and spaced from the end of the male tubular section.

2. The heat exchanger as claimed in claim 1, wherein the at least one insert is integral with at least one of the first plate, the second plate, and the side plate.

3. The heat exchanger as claimed in claim 1, wherein the at least one insert is a component which is fitted to at least one of the first plate of the adjacent fluid circulation pipe, the second plate of the adjacent fluid circulation pipe, and the side plate.

4. The heat exchanger as claimed in claim 2, wherein the tubular section terminates in an edge which covers the male dished member of the stacked plate of an adjacent fluid circulation pipe, the edge extending in continuation of the tubular section.

5. The heat exchanger as claimed in claim 1, wherein the base is provided with an opening through which a fluid passes.

6. The heat exchanger as claimed in claim 1, wherein each one of the stacked plates comprises a fluid circulation portion which is interposed between two plate ends, the male dished member being formed at least at one end of each one of the stacked plates.

7. The heat exchanger as claimed in claim 1, wherein at least one end of the first plate, the second plate, and the side plate includes both the male dished member and the female dished member.

8. The heat exchanger as claimed in claim 1, wherein each one of the side plate and a second side plate has a thickness of 1 mm.

9. The exchanger as claimed in claim 1, wherein the at least one insert has a thickness greater than 0.3 mm.

10. The heat exchanger as claimed in claim 3, wherein the tubular section terminates in an edge which covers the male dished member of the adjacent fluid circulation pipe, the edge extending in continuation of the tubular section.

11. The heat exchanger as claimed in claim 1, wherein the width of the planar member is equal to the depth of the multiplicity of stacked plates.

12. The heat exchanger as claimed in claim 1, wherein the planar member is soldered to the side plate so as to reinforce the heat exchanger.

13. The heat exchanger as claimed in claim 1, wherein the at least one insert includes a plurality of tongues extending perpendicularly from the planar member, and the plurality of tongues are folded onto the side plate to attach the at least one insert to the side plate.

14. The heat exchanger as claimed in claim 1, wherein the tubular section extends from the planar member and has a center axis that is perpendicular to the planar member.

15. The heat exchanger as claimed in claim 1, wherein the at least one insert does not comprise a flow blocking means.

16. The heat exchanger as claimed in claim 1, wherein the tubular section of the at least one insert straddles the male tubular section of the male dished member, such that the tubular section of the at least one insert has an inner diameter, and the male tubular section of the male dished member has an outer diameter that is equal to the inner diameter of the tubular section of the at least one insert.

17. A heat exchanger comprising a multiplicity of stacked plates, each one of the stacked plates having a thickness of less than 0.3 mm and provided with a male dished member which delimits a fluid distribution zone in the heat exchanger, wherein the multiplicity of stacked plates comprises at least a first plate and a second plate, each one of the first plate and the second plate comprises a peripheral edge which is assembled in a fluid-tight manner in order to form a fluid circulation pipe, and wherein the exchanger comprises at least one insert which is provided with a female dished member, the male dished member of the stacked plates being configured to be introduced into the female dished member of the at least one insert in order to ensure fixing between a side plate and an adjacent fluid circulation pipe;

wherein each one of the at least one insert includes a planar member and a tubular section, the planar member extending laterally outward from the tubular section so as to define a periphery of the at least one insert, the planar member being attached to the side plate and the tubular section having an interior and receiving the male dished member within the interior of the tubular section so as to reinforce the heat exchanger;

wherein the male dished member of each one of the stacked plates has a male tubular section which terminates in a base, with the base extending in a plane perpendicular to a center axis of the male tubular section and radially inwardly from the male tubular section toward the center axis, with the male tubular section being received in the interior of the tubular section of the at least one insert;

wherein the side plate comprises a first side plate which is located in a region of a first side of the heat exchanger and a second side plate which is located in a region of a second side of the heat exchanger, wherein two of the inserts are installed against a corresponding one of the first and second side plates so that the female dished member of each one of the two inserts covers the male dished member of a corresponding one of the plates adjacent to the first side plate and the second side plate; and wherein the male tubular section terminates in an end opposite to the base, and the at least one insert terminates in an edge, with the edge being disposed opposite to the planar member and spaced from the end of the male tubular section.

18. The heat exchanger as claimed in claim 17, wherein the at least one insert does not comprise a flow blocking means.

* * * * *